US012590373B2

(12) United States Patent
Ikeda et al.

(10) Patent No.: US 12,590,373 B2
(45) Date of Patent: Mar. 31, 2026

(54) AQUEOUS COMPOSITION, STAINLESS STEEL SURFACE ROUGHENING METHOD USING SAME, AND METHOD FOR MANUFACTURING ROUGHENED STAINLESS STEEL

(71) Applicant: MITSUBISHI GAS CHEMICAL COMPANY, INC., Tokyo (JP)

(72) Inventors: Kazuhiko Ikeda, Kanagawa (JP); Tomoko Fujii, Tokyo (JP); Hiroshi Matsunaga, Yokkaichi (JP)

(73) Assignee: MITSUBISHI GAS CHEMICAL COMPANY, INC., Tokyo (JP)

( * ) Notice: Subject to any disclaimer, the term of this patent is extended or adjusted under 35 U.S.C. 154(b) by 108 days.

(21) Appl. No.: 18/266,888

(22) PCT Filed: Dec. 13, 2021

(86) PCT No.: PCT/JP2021/045739
§ 371 (c)(1),
(2) Date: Jun. 13, 2023

(87) PCT Pub. No.: WO2022/131188
PCT Pub. Date: Jun. 23, 2022

(65) Prior Publication Data

US 2024/0044015 A1 Feb. 8, 2024

(30) Foreign Application Priority Data

Dec. 15, 2020 (JP) ..... 2020-207187

(51) Int. Cl.
*C23F 1/28* (2006.01)

(52) U.S. Cl.
CPC ..... *C23F 1/28* (2013.01)

(58) Field of Classification Search
None
See application file for complete search history.

(56) References Cited

U.S. PATENT DOCUMENTS

| | | | | |
|---|---|---|---|---|
| 5,082,723 | A * | 1/1992 | Gross | A61L 15/60 428/401 |
| 6,214,129 | B1 * | 4/2001 | Nakaoka | B08B 3/10 134/28 |
| 2003/0027433 | A1 * | 2/2003 | Faur | H01L 21/31675 438/770 |
| 2010/0001106 | A1 * | 1/2010 | Schaefer | B02C 21/00 134/2 |
| 2010/0178764 | A1 * | 7/2010 | Narita | H01L 21/2855 257/E21.296 |
| 2010/0300495 | A1 * | 12/2010 | Wochner | C01B 33/00 134/34 |
| 2012/0132275 | A1 | 5/2012 | Nishida et al. | |
| 2012/0174960 | A1 * | 7/2012 | Hashigami | H10F 77/211 257/E31.124 |
| 2017/0092955 | A1 | 3/2017 | Ashizawa et al. | |
| 2019/0003061 | A1 * | 1/2019 | Michalik | C23F 1/02 |
| 2020/0194779 | A1 | 6/2020 | Kawaguchi | |
| 2022/0251714 | A1 | 8/2022 | Ikeda et al. | |
| 2022/0325419 | A1 * | 10/2022 | Ikeda | C23F 1/28 |
| 2023/0238251 | A1 * | 7/2023 | Naito | C23F 1/26 252/79.1 |
| 2023/0294996 | A1 * | 9/2023 | Sakida | C01B 33/02 423/348 |
| 2024/0044014 | A1 * | 2/2024 | Ikeda | C22C 38/00 |
| 2024/0044015 | A1 * | 2/2024 | Ikeda | C23F 1/28 |

FOREIGN PATENT DOCUMENTS

| | | | |
|---|---|---|---|
| CN | 104233302 | A | 12/2014 |
| CN | 104805440 | A | 7/2015 |
| CN | 111421747 | A | 7/2020 |
| EP | 2175049 | A1 | 4/2010 |
| EP | 3124650 | A1 | 2/2017 |
| EP | 3184669 | A1 | 6/2017 |
| JP | S58-193372 | A | 11/1983 |
| JP | 2011168017 | A | 9/2011 |
| JP | 2011168868 | A | 9/2011 |
| JP | 2015183239 | A | 10/2015 |
| WO | WO-2010016485 | A1 | 2/2010 |
| WO | WO-2011021299 | A1 | 2/2011 |
| WO | WO-2015186752 | A1 | 12/2015 |
| WO | WO-2019039332 | A1 | 2/2019 |
| WO | WO-2020250784 | A1 | 12/2020 |
| WO | WO-2021020253 | A1 | 2/2021 |

OTHER PUBLICATIONS

Extended European Search Report issued May 31, 2024 in corresponding European Patent Application No. 21906550.5, 11 pages.
International Search Report issued Feb. 22, 2022 in PCT/JP2021/045739 (with English translation), 7 pages.

* cited by examiner

*Primary Examiner* — Allan W. Olsen
(74) *Attorney, Agent, or Firm* — Element IP, PLC

(57) ABSTRACT

The problem of the present invention is to provide an aqueous composition with which the surface of stainless steel is sufficiently roughened in an efficient manner with few steps, while maintaining good quality (e.g., thickness) of the stainless steel after treatment. The above problem is solved by the following aqueous composition for roughening the surface of stainless steel. Namely, the aqueous composition comprises 0.1% to 10% by mass of hydrogen peroxide based on the total amount of the aqueous composition, 1% to 30% by mass of halide ions based on the total amount of the aqueous composition, and 0% to 3% by mass of copper ions based on the total amount of the aqueous composition.

10 Claims, No Drawings

AQUEOUS COMPOSITION, STAINLESS STEEL SURFACE ROUGHENING METHOD USING SAME, AND METHOD FOR MANUFACTURING ROUGHENED STAINLESS STEEL

TECHNICAL FIELD

The present invention relates to an aqueous composition for use in the surface treatment of stainless steel, and a roughening treatment method for stainless steel surface using the aqueous composition, etc.

BACKGROUND ART

Because of its properties excellent in durability and weather resistance, stainless steel has recently been considered for application in various fields. For example, stainless steel is coming into widespread use in electronic components, battery current collector foils and automotive component housings. In more detail, when stainless steel is used in battery current collector foils or automotive component housings, the surface of stainless steel is roughened with the aim of adhering dielectric substances or organic materials. Alternatively, when stainless steel is used for heat radiation purposes, the surface of stainless steel is roughened with the aim of facilitating heat radiation.

When stainless steel is used for such purposes in each product, there is a need to increase the surface area of stainless steel. To this end, some methods have been known for treating the surface of stainless steel, e.g., with a treatment liquid containing iron chloride (e.g., Patent Literature 1). However, according to such a treatment method, many flat regions still remain on the surface of stainless steel after the treatment; and hence the surface of stainless steel is not always roughened sufficiently for the above purposes.

Moreover, as techniques to roughen the surface of stainless steel, those involving wet peening in combination with chemical roughening treatment have been found (e.g., Patent Literature 2). However, according to these techniques, the step of surface treatment in a particular manner is required prior to the roughening treatment. For this reason, there is room for improvement in terms of roughening treatment efficiency.

CITATION LIST

Patent Literature

Patent Literature 1: JP 2011-168017 A
Patent Literature 2: JP 2015-183239 A

SUMMARY OF INVENTION

Technical Problem

As described above, in the conventional roughening treatment of stainless steel surface, the roughening level is not always sufficient, and the treatment time and costs are also increased because complicated steps are required. For this reason, there has been a demand for a method allowing sufficient roughening treatment on the surface of stainless steel in an efficient manner with simple steps.

Moreover, the quality of stainless steel after roughening treatment may become a problem in some cases. In particular, in the roughening treatment of a stainless steel foil whose thickness is small, it is becoming clear that a foil of good quality is not easy to obtain after the treatment. Namely, there may also be a demand for improvement in the surface quality of stainless steel after roughening treatment, etc. For example, a problem has been recognized in that the surface of stainless steel obtained upon roughening treatment does not have a uniform thickness, particularly in that when stainless steel to be treated is in the form of a thin foil, pinholes may occur, which may hinder the commercialization of stainless steel.

The problem of the present invention is to allow sufficient roughening treatment on the surface of stainless steel in an efficient manner with simple steps, and also to achieve a method for stably obtaining roughened stainless steel whose quality (e.g., thickness) is good.

Solution to Problem

As a result of repeating extensive and intensive efforts to achieve the problem stated above, the inventors of the present invention have found that when using an aqueous composition of particular composition, the surface of stainless steel can be sufficiently roughened in an efficient manner with few steps, and extremely thin regions or pinholes can also be prevented from occurring to thereby achieve stainless steel of good quality. This finding led to the completion of the present invention.

Namely, the present invention is as shown below.

[1] An aqueous composition for roughening the surface of stainless steel, which comprises:
- 0.1% to 10% by mass of hydrogen peroxide based on the total amount of the aqueous composition;
- 1% to 30% by mass of halide ions based on the total amount of the aqueous composition; and
- 0% to 3% by mass of copper ions based on the total amount of the aqueous composition.

[2] The aqueous composition according to [1] above, wherein a compound supplying the halide ions comprises one or more selected from the group consisting of hydrochloric acid, sodium chloride and copper chloride.

[3] The aqueous composition according to [1] or [2] above, wherein the content of the copper ions is 1.5% by mass or less based on the total amount of the aqueous composition.

[4] The aqueous composition according to any one of [1] to [3] above, wherein the content of the hydrogen peroxide is 0.1% to 3% by mass based on the total amount of the aqueous composition.

[5] A roughening treatment method for stainless steel, which comprises a roughening treatment step in which roughening treatment is performed on the surface of stainless steel using the aqueous composition according to any one of [1] to [4] above.

[6] The roughening treatment method for stainless steel according to [5] above, wherein regions of stainless steel on which the roughening treatment is performed have at least sites whose thickness is 15 μm or less.

[7] The roughening treatment method for stainless steel according to [6] above, wherein all the regions of stainless steel on which the roughening treatment is performed have a thickness of 15 μm or less.

[8] The roughening treatment method for stainless steel according to any one of [5] to [7] above, wherein the stainless steel is a stainless steel foil.

[9] The roughening treatment method for stainless steel according to any one of [5] to [8] above, wherein the maximum height (Rz) of the surface of roughened stainless steel as defined in JIS B 0601-2001 is 1.0 μm or more.

[10] The roughening treatment method for stainless steel according to any one of [5] to [9] above, wherein the maximum height (Rz) of the surface of roughened stainless steel as defined in JIS B 0601-2001 is 5.0 μm or less.

[11] The roughening treatment method for stainless steel according to any one of [5] to [10] above, wherein the maximum height (Rz) of the surface of roughened stainless steel as defined in JIS B 0601-2001 is 0.3 μm or more greater than the maximum height (Rz) of the surface of untreated stainless steel.

[12] The roughening treatment method for stainless steel according to any one of [5] to [11] above, wherein the arithmetical mean roughness (Ra) of the surface of roughened stainless steel as defined in JIS B 0601-2001 is 0.1 μm or more.

[13] The roughening treatment method for stainless steel according to any one of [5] to [12] above, wherein the arithmetical mean roughness (Ra) of the surface of roughened stainless steel as defined in JIS B 0601-2001 is 1.0 μm or less.

[14] The roughening treatment method for stainless steel according to any one of [5] to [13] above, wherein the arithmetical mean roughness (Ra) of the surface of roughened stainless steel as defined in JIS B 0601-2001 is 0.04 μm or more greater than the arithmetical mean roughness (Ra) of the surface of untreated stainless steel.

[15] The roughening treatment method for stainless steel according to any one of [5] to [14] above, wherein the stainless steel is at least any of the following defined in JIS G4305:

chromium-nickel stainless steel including SUS304, SUS316, SUS321, SUS347, and SUS329J1;

ferrite stainless steel (chromium stainless steel) including SUS405, SUS430, SUS434, SUS444, SUS447, and SUSXM27; and precipitation hardening stainless steel (chromium-nickel stainless steel) including SUS630, SUS631, and SUH660.

[16] A method for manufacturing roughened stainless steel, which comprises a roughening treatment step in which roughening treatment is performed on the surface of stainless steel using the aqueous composition according to any one of [1] to [4] above.

[17] The method for manufacturing roughened stainless steel according to [16] above, wherein the stainless steel is at least any of the following defined in JIS G4305:

chromium-nickel stainless steel including SUS304, SUS316, SUS321, SUS347, and SUS329J1;

ferrite stainless steel (chromium stainless steel) including SUS405, SUS430, SUS434, SUS444, SUS447, and SUSXM27; and precipitation hardening stainless steel (chromium-nickel stainless steel) including SUS630, SUS631, and SUH660.

[18] The method for manufacturing roughened stainless steel according to [16] or [17] above, wherein the stainless steel is a stainless steel foil.

[19] The method for manufacturing roughened stainless steel according to any one of [16] to [18] above, wherein regions of stainless steel on which the roughening treatment is performed have at least sites whose thickness is 15 μm or less.

[20] The method for manufacturing roughened stainless steel according to [19] above, wherein all the regions of stainless steel on which the roughening treatment is performed have a thickness of 15 μm or less.

[21] A battery current collector foil, a solar battery substrate, a flexible substrate for electronic devices, a substrate for electric accumulator devices, a catalyst carrier, an electromagnetic wave shielding member, or a heat radiating member, which comprises the roughened stainless steel manufactured by the method for manufacturing roughened stainless steel according to any one of [16] to [20] above.

Advantageous Effects of Invention

According to the present invention, the surface of stainless steel can be sufficiently roughened in an efficient manner with few steps, and extremely thin regions or pinholes can be prevented from occurring to thereby stably obtain roughened stainless steel of good quality.

DESCRIPTION OF EMBODIMENTS

The present invention will be further described in more detail below. The present invention is not limited to the following descriptions, and various modifications may be made without departing from the spirit of the present invention.

[1. Aqueous Composition]

The aqueous composition of the present invention is preferred for use in the roughening treatment of metal surface, i.e., treatment to roughen the metal surface to give a more uneven surface. A target preferred for roughening treatment with the aqueous composition of the present invention is exemplified by various types of stainless steel as described in detail later.

The aqueous composition of the present invention comprises 0.1% to 10% by mass of hydrogen peroxide, 1% to 30% by mass of halide ions, and 0% to 3% by mass of copper ions, based on the total amount of the aqueous composition. In addition to these components, the aqueous composition may comprise water, etc., especially ion exchanged water or ultrapure water.

Each component of the aqueous composition will be explained below.

<1-1. Hydrogen Peroxide>

Hydrogen peroxide to be contained in the aqueous composition is usually provided as an aqueous solution of appropriate concentration for admixture with other components. The concentration of hydrogen peroxide in an aqueous hydrogen peroxide solution for use in the preparation of the aqueous composition is not limited in any way, and it may be for example 10% to 90%, and is preferably 35% to 60% in line with the industrial standards.

Moreover, hydrogen peroxide may contain a stabilizer in an amount up to around 0.01% by mass, and acceptable stabilizers include sulfuric acid, phosphoric acid and so on. Hydrogen peroxide may be prepared in any manner and may be available through any route. For example, hydrogen peroxide prepared by the anthraquinone method may be used.

The concentration of hydrogen peroxide in the aqueous composition is 0.1% to 10% by mass based on the total amount (total mass) of the aqueous composition, but it is preferably 0.12% to 7% by mass, more preferably 0.15% to 5% by mass, or 0.1% to 3% by mass, based on the total amount (total mass) of the aqueous composition, and may be 0.1% to (less than) 2% by mass based on the total amount (total mass) of the aqueous composition.

Moreover, the lower limit of the concentration of hydrogen peroxide in the aqueous composition may be, for example, 0.001% by mass, 0.01% by mass, 0.05% by mass, 0.15% by mass, 0.2% by mass, 0.3% by mass, 0.5% by mass, 1.0% by mass, 1.5% by mass, or 2.0% by mass, based on the total amount (total mass) of the aqueous composition, while the upper limit of the concentration of hydrogen peroxide contained in the aqueous composition may be, for example, 15% by mass, 12% by mass, 10% by mass, 7% by mass, 6% by mass, 5% by mass, 4% by mass, 3.5% by mass, 3% by mass, 2.5% by mass, 2% by mass, 1.5% by mass, etc., based on the total amount (total mass) of the aqueous composition. The concentration range of hydrogen peroxide may be selected as appropriate from the above lower and upper limits combined as appropriate, for example, 0.001% to 15% by mass, 0.01% to 15% by mass, 0.05% to 12% by mass, to 7% by mass, 0.1% to 7% by mass, 0.1% to 5% by mass, 0.1% to 3% by mass, to 2% by mass, 0.2% to 10% by mass, 0.2% to 7% by mass, 0.2% to 6% by mass, to 5% by mass, 0.3% to 3% by mass, etc.

As a result of selecting the concentration of hydrogen peroxide from among the ranges mentioned above, the effect of the present invention tends to be achieved in a more preferred manner, and even when copper ions, halide ions and others described later are also contained in the aqueous composition, the possibility of heat generation or bubble formation associated with the decomposition of hydrogen peroxide can be suppressed to thereby ensure the safety of operation.

<1-2. Halide Ions (Halogen Ions)>

Halide ions to be contained in the aqueous composition may be of any type, and examples include fluoride ions, chloride ions, bromide ions and iodide ions, with chloride ions being more preferred in terms of easy handling and cost effectiveness.

Halogen compounds supplying halide ions are not limited in any way, and examples include alkali metal halides (e.g., sodium halides and potassium halides), alkaline earth metal halides (e.g., calcium halides), ammonium halides, copper halides, and hydrogen halides. Among them, preferred are alkali metal halides or hydrogen halides in terms of more effectively and reliably providing the effect of the present invention, and more preferred is hydrochloric acid or sodium chloride.

Such halogen compounds are used either alone or in combination. It should be noted that halogen compounds may overlap with copper compounds described later. For example, when a copper halide is used as a source of halide ions, this copper halide also falls within copper compounds described later, which serve as a copper ion source. Copper chloride is preferred as a copper halide. Halogen compounds (halide ions) will cause pitting corrosion on the passive film during the roughening treatment of the stainless steel surface.

The concentration of halide ions in the aqueous composition is 1% to 30% by mass, based on the total amount (total mass) of the aqueous composition, but it is preferably 2.0% to 25% by mass, more preferably 4.0% to 22% by mass or 3.0% to 20% by mass, and particularly preferably 5.0% to 15% by mass, 8% to 15% by mass or 10% to 15% by mass, based on the total amount (total mass) of the aqueous composition.

Moreover, as to the concentration range of halide ions in the aqueous composition, the lower limit may be set to any of 0.01% by mass, 0.1% by mass, 0.5% by mass, 1.0% by mass, 2.0% by mass, 3.0% by mass, 5.0% by mass and 8.0% by mass, based on the total amount (total mass) of the aqueous composition, while the upper limit may be set to any of 24% by mass, 22% by mass, 20% by mass, 15% by mass, 12% by mass and 10% by mass, based on the total amount of the aqueous composition. The concentration range of halide ions may be selected as appropriate from the above lower and upper limits combined as appropriate, for example, 0.1% to 24% by mass, 1.0% to 24% by mass, 0.1% to 22% by mass, 1.0% to 22% by mass, 0.01% to 20% by mass, 0.05% to 20% by mass, 0.1% to 20% by mass, 1.0% to 15% by mass, 1.5% to 15% by mass, 2.0% to 15% by mass, 3.0% to 12% by mass, 5.0% to 12% by mass, 8.0% to 10% by mass, etc.

As a result of selecting the concentration of halide ions from among the ranges mentioned above, the effect of the present invention tends to be achieved in a more preferred manner. In more detail, in the aqueous composition whose concentration of halide ions is within the above range, a roughened pattern can be developed while preventing the progression of pitting corrosion reaction on stainless steel, and the decomposition reaction of hydrogen peroxide can also be prevented to ensure safety.

<1-3. Copper Ions>

The concentration of copper ions in the aqueous composition is 0% to 3% by mass based on the total amount (total mass) of the aqueous composition. Namely, the aqueous composition intended in the present invention is free from copper ions or has a copper ion content of 3% by mass or less based on the total amount (total mass) of the aqueous composition. Copper ions in the aqueous composition can be generated by mixing a copper compound serving as a copper ion source with other components. The copper ion source may be of any type, as long as it is a copper compound capable of supplying copper ions in the aqueous composition.

Examples of such a copper compound include copper sulfate (e.g., cupric sulfate), copper chloride (e.g., cupric chloride), copper tetrafluoroborate, cupric bromide, cupric oxide, copper phosphate, copper acetate, copper formate, copper nitrate and so on, which may be in anhydride form or in pentahydrate form. Among them, preferred is copper sulfate or copper chloride in terms of more effectively and reliably providing the effect of the present invention and in terms of easy handling and cost effectiveness, more preferred is cupric sulfate or cupric chloride, and even more preferred is cupric sulfate. These members may be used either alone or in combination.

It is inferred that copper ions contained in the aqueous composition will cause substitution reaction for nickel and chromium, which are components of stainless steel, during the roughening treatment, and substitution reaction products derived from copper ions are then removed to obtain a roughened pattern.

Moreover, in terms of the quality of stainless steel after the roughening treatment, particularly when the aqueous composition is used in the treatment of a stainless steel foil whose thickness is small, the content of copper ions is preferably adjusted to prevent the occurrence of extremely thin regions or pinholes, as described later.

The concentration of copper ions contained in the aqueous composition is 3% by mass or less, preferably 2% by mass or less, less than 1.5% by mass or 1.5% by mass or less, and more preferably 1.2% by mass or less or 1.0% by mass or less, and may be by mass or less, 0.5% by mass or less, or less than 0.25% by mass. The concentration range of copper ions is 0% to 3% by mass, preferably 0% to 2% by mass, more preferably 0% to 1.5% by mass, and even more preferably 0.1% to 1.5% by mass, and may be 0.2% to 1.5% by mass.

The lower limit of the concentration of copper ions in the aqueous composition is 0% by mass based on the total amount (total mass) of the aqueous composition, but may be for example 0.00001% by mass (0.1 mass ppm), 0.0001% by mass (1 mass ppm), 0.001% by mass, 0.01% by mass, 0.02% by mass, 0.03% by mass, 0.05% by mass, 0.07% by mass, or 0.1% by mass, based on the total amount (total mass) of the aqueous composition.

Likewise, the upper limit of the concentration of copper ions in the aqueous composition may be, for example, 3% by mass, 2.5% by mass, 2% by mass, 1.7% by mass, 1.5% by mass, 1% by mass, 0.5% by mass, 0.3% by mass, 0.22% by mass, 0.16% by mass, 0.14% by mass, etc., based on the total amount of the aqueous composition. The concentration range of copper ions may be selected as appropriate from the above lower and upper limits combined as appropriate, for example, 0.0001% to 3% by mass, to 3% by mass, 0.01% to 2% by mass, 0.01% to 1.7% by mass, 0.01% to 1.5% by mass, 0.02% to 1% by mass, 0.03% to 0.25% by mass, 0.03% to 0.20% by mass, to 0.15% by mass, 0.05% to 0.12% by mass, etc.

As a result of selecting the concentration of copper ions from among the ranges mentioned above, the effect of the present invention tends to be achieved in a more preferred manner.

On the other hand, if the concentration of copper ions in the aqueous composition is too high, pinholes or extremely thin regions are more likely to occur on stainless steel after the roughening treatment. If the concentration of copper ions is too low, the roughening treatment will probably not proceed efficiently.

<1-4. Additives Contained in the Aqueous Composition>

The aqueous composition of the present invention may comprise additives as components other than hydrogen peroxide, copper ions and halide ions mentioned above, as long as the effect of the present invention is exerted. Examples of such additives include heterocyclic nitrogen compounds (azole compounds), organic solvents and so on. These additives are used either alone or in combination. Moreover, additives also include a surfactant, a pH adjuster and so on, but they are preferably not contained in the aqueous composition of the present invention.

The concentration of additives which may be contained in the aqueous composition is preferably 10% by mass or less, more preferably 5.0% by mass or less, even more preferably 2.0% by mass or less, and particularly preferably 1.0% by mass or less.

<1-5. Water>

The aqueous composition of the present invention may comprise water, and preferably comprises water. The water intended here is not limited in any way, but it is preferably water which has been treated to remove metal ions, organic impurities, particles and so on by distillation, ion exchange treatment, filter treatment, various adsorption treatments, etc., and it is more preferably pure water, and particularly preferably ultrapure water.

The content of water in the aqueous composition of the present invention is the balance of the composition (i.e., other than the individual components described above and additives described in detail later), and is not limited in any way, but it is preferably 50% to 98% by mass, more preferably 60% to 95% by mass, even more preferably 75% to 93% by mass, and particularly preferably 85% to 90% by mass, based on the total amount (total mass) of the aqueous composition.

It should be noted that the aqueous composition of the present invention is preferably in the form of a solution, and is preferably free from components which are non-soluble in the composition in the form of a solution, as exemplified by solid particles such as abrasive particles.

<1-6. Function and Properties of the Aqueous Composition>

The aqueous composition comprising the above individual components is deemed to function as follows during the roughening treatment of the stainless steel surface.

Halide ions are responsible for pitting corrosion of the oxide film which is usually formed on the surface of stainless steel. Copper ions have the effect of causing substitution reaction for nickel and chromium, which are components of stainless steel, as described above, and substitution reaction products derived from copper ions are then removed to form an uneven pattern with high Rz, i.e., a roughened pattern on the surface of stainless steel.

Likewise, hydrogen peroxide serves to remove the above substitution reaction products derived from copper ions after the substitution reaction.

Moreover, the aqueous composition comprising copper ions and others whose content is adjusted within an appropriate range can prevent the occurrence of extremely thin regions or pinholes on stainless steel after the roughening treatment, particularly on a stainless steel foil after the roughening treatment.

The aqueous composition of the present invention may be prepared by stirring the hydrogen peroxide-containing component, the halide ion-supplying component and water mentioned above, optionally together with the copper ion-supplying component and other components, until a uniform mixture is obtained.

The properties of the aqueous composition are not limited in any way, but its pH value is preferably −1.0 to 4.0, more preferably −0.5 to 3.0, even more preferably −0.25 to 2.5, and particularly preferably −0.1 to 2.0, 0.0 to 1.5, 0.005 to 1.0, or 0.01 to 0.5. The pH value may be measured by the method described in the Example section.

[2. Roughening Treatment Method for Stainless Steel]

In the roughening treatment method for roughening the surface of stainless steel (herein also referred to as the roughening treatment method for stainless steel) according to the present invention, a roughening treatment step is conducted. Namely, the roughening treatment method of the present invention comprises a roughening treatment step in which the above aqueous composition is used to perform roughening treatment on the surface of stainless steel. In the context of the present invention, performing roughening treatment on the surface of stainless steel using the aqueous composition is intended to mean bringing the aqueous composition for use in the treatment into contact with the surface of stainless steel. As can be seen from this, the roughening treatment method for stainless steel of the present invention comprises at least the step of bringing the aqueous composition into contact with the surface of stainless steel.

<2-1. Roughening Treatment Step>

The roughening treatment step is to perform roughening treatment by bringing the above aqueous composition into contact with stainless steel to be subjected to the roughening treatment.

In the roughening treatment step, the temperature required for roughening treatment is preferably 20° C. to 60° C., more preferably 25° C. to 55° C., and particularly preferably 30° C. to 50° C. Thus, the roughening treatment method for stainless steel of the present invention is advantageous in that the surface roughening of stainless steel proceeds even at not so high temperature, for example, even at room temperature of 25° C. In the context of the present invention, the temperature required for roughening treatment is intended to mean the temperature at which the aqueous composition is brought into contact with the surface of stainless steel, particularly the solution temperature of the aqueous composition to be brought into contact with the surface of stainless steel.

Moreover, in the roughening treatment step, the time required for roughening treatment is preferably 30 seconds to 120 seconds, more preferably 40 seconds to 100 seconds, and particularly preferably 50 seconds to 90 seconds. Thus, the roughening treatment method for stainless steel of the present invention is advantageous in that the roughening of stainless steel proceeds even within not so long time. In the context of the present invention, the time required for roughening treatment is intended to mean the time during which the aqueous composition is in contact with the surface of stainless steel. For example, it means the time during which stainless steel is soaked in the aqueous composition, or the time required from spraying the aqueous composition over the surface of stainless steel until removing the aqueous composition by water washing, etc.

Any method may be used to bring the aqueous composition into contact with the surface of stainless steel. For example, it is possible to select a method in which the aqueous composition is brought into contact with stainless steel in a dropwise manner or in a spraying (spray treatment) manner, etc., or a method in which stainless steel is soaked in the aqueous composition. In the present invention, either of these methods may be selected for this purpose. For example, the aqueous composition may be sprayed over stainless steel processed into a specific shape to obtain roughened stainless steel, or alternatively, an apparatus for adding dropwise, spraying or soaking the aqueous composition is provided between stainless steel foil rolls, and a stainless steel foil is passed near the above apparatus to supply the aqueous composition during being conveyed in a roll-to-roll fashion from the roll around which the untreated stainless steel foil has been wound, and the roughened stainless steel foil is then wound around the other roll.

As described in detail later, it should be noted that the stainless steel roughened in the roughening treatment step may be subjected to water washing or other treatment.

<2-2. Surface Roughness of Stainless Steel after Roughening Treatment>

According to the roughening treatment method for stainless steel of the present invention, the maximum height (Rz) of the surface of stainless steel after the roughening treatment (herein also referred to as roughened stainless steel; a stainless steel foil (film or sheet) also falls within stainless steel) can be 1.0 μm or more, 2.0 μm or more, or 3.0 μm or more.

Namely, in the roughening treatment method for stainless steel of the present invention, not only in stainless steel immediately after the roughening treatment step, but also in the surface of roughened stainless steel finally obtained after completion of all the steps including water washing on stainless steel, the maximum height (Rz) of the surface can be 1.0 μm or more, 2.0 μm or more, 2.5 μm or more, 3.0 μm or more, or 3.5 μm or more.

The same goes for the parameters (including Ra) of surface roughness shown below in that the roughening level intended is achieved in the surface of stainless steel obtained immediately after the roughening treatment step or obtained as a final product.

In the roughening treatment method for stainless steel of the present invention, the maximum height (Rz) of the roughened stainless steel surface after the roughening treatment step can be preferably 1.0 μm or more, and more preferably 1.5 μm or more, and may be 2.0 μm or more, 2.5 μm or more, or 3.0 μm or more.

In addition, there is no particular limitation on the upper limit of the maximum height (Rz) of the surface of roughened stainless steel, but the upper limit is for example 5.0 μm or less, and may be 4.0 μm or less, or 3.0 μm or less.

It should be noted that the maximum height (Rz) of the surface of stainless steel in a state not receiving the roughening treatment (herein also referred to as untreated stainless steel) is not limited in any way, but it is for example 0.2 to 2.0 μm, etc., and is around 0.5 to 1.5 μm.

In the roughening treatment method for stainless steel of the present invention, the maximum height (Rz) of the roughened stainless steel surface after the roughening treatment step can be a value which is 0.1 μm or more greater than the maximum height (Rz) of the surface of untreated stainless steel, and is preferably a value which is 0.3 μm or more greater than that of untreated stainless steel, more preferably a value which is μm or more greater than that of untreated stainless steel, and even more preferably a value which is 1.0 μm or more greater than that of untreated stainless steel, and may be a value which is 1.5 μm or more greater than that of untreated stainless steel.

In the roughening treatment method for stainless steel of the present invention, the arithmetical mean roughness (Ra) of the surface of roughened stainless steel after the roughening treatment step can be 0.1 μm or more. In the roughening treatment method for stainless steel of the present invention, the arithmetical mean roughness (Ra) of the surface of roughened stainless steel after the roughening treatment step can be preferably 0.15 μm or more, or 0.2 μm or more, and more preferably 0.3 μm or more, or 0.4 μm or more, and may be 0.5 μm or more, or 0.6 μm or more.

In addition, there is no particular limitation on the upper limit of the arithmetical mean roughness (Ra) of the surface of roughened stainless steel, but the upper limit is for example 1.0 μm or less, and may be 0.8 μm or less, or 0.7 μm or less.

It should be noted that the arithmetical mean roughness (Ra) of untreated stainless steel is not limited in any way, but it is for example 0.03 to 1.0 μm, and preferably 0.05 to 0.5 μm.

In the roughening treatment method for stainless steel of the present invention, the arithmetical mean roughness (Ra) of the surface of roughened stainless steel after the roughening treatment step can be a value which is 0.02 μm or more greater than the arithmetical mean roughness (Ra) of the surface of untreated stainless steel, and is preferably a value which is 0.04 μm or more greater than that of untreated stainless steel, more preferably a value which is 0.10 μm or more greater than that of untreated stainless steel, even more preferably a value which is 0.20 μm or more greater than that of untreated stainless steel, and particularly preferably a value which is 0.30 μm or more greater than that of untreated stainless steel, and may be a value which is 0.40 μm or more or 0.50 μm or more greater than that of untreated stainless steel.

The above maximum height (Rz) and arithmetical mean roughness (Ra) are calculated according to JIS B 0601-2001. The apparatus used for measurement of these parameters is not limited in any way, and a laser microscope may be used for this purpose, by way of example.

It should be noted that the surface of roughened stainless steel on which deposits have been generated after the roughening treatment may be treated with a physical means (e.g., an adhesive tape) to remove the deposits, prior to the measurement of the maximum height (Rz) and arithmetical mean roughness (Ra) after the roughening treatment step. However, such a physical means is not always practical as a part of the manufacturing process.

The etching rate of stainless steel in the roughening treatment step is not limited in any way, but it is for example 0.1 μm/min or more, preferably 0.5 μm/min or more, more preferably 0.7 μm/min or more, and even more preferably 1.0 μm/min or more, and may be 1.5 μm/min or more, 2.0 μm/min or more, 2.5 μm/min or more, 3.0 μm/min or more, or 3.5 μm/min or more.

According to the roughening treatment method for stainless steel described above, stainless steel with a more uneven surface can be obtained simply by a substantially single-step treatment, i.e., roughening treatment alone in which the aqueous composition of the present invention is brought into contact with the surface of stainless steel to be treated, or optionally in combination with appropriate washing (e.g., water washing).

Moreover, as described above, the treatment conditions used in the roughening treatment are mild, and the time required for this treatment is also short, so that the present invention enables the efficient roughening treatment of stainless steel.

[3. Stainless Steel]

There is no particular limitation on the type of stainless steel to be subjected to the roughening treatment with the aqueous composition of the present invention, but examples include the following.

Namely, examples include those defined in JIS G4305, as exemplified by chromium-nickel stainless steel including SUS304, SUS316, SUS321, SUS347, and SUS329J1; ferrite stainless steel (chromium stainless steel) including SUS405, SUS430, SUS434, SUS444, SUS447, and SUSXM27; and precipitation hardening stainless steel (chromium-nickel stainless steel) including SUS630, SUS631, and SUH660.

Among the above stainless steels, SUS304 and SUS444 are more preferred as those to be subjected to the roughening treatment with the aqueous composition.

Moreover, as described above, the maximum height (Rz) of the surface of roughened stainless steel is for example 1.0 μm or more, and preferably 1.5 μm or more, and may be 2.0 μm or more, 2.5 μm or more, or 3.0 μm or more.

Likewise, there is no particular limitation on the upper limit of the maximum height (Rz) of the surface of roughened stainless steel, but the upper limit is for example 5.0 μm or less, and may be 4.0 μm or less, or 3.0 μm or less.

The arithmetical mean roughness (Ra) of the surface of roughened stainless steel is for example 0.1 ?μm or more, preferably 0.15 μm or more, or 0.2 μm or more, and even more preferably 0.3 μm or more, or 0.4 μm or more, and may be 0.5 μm or more.

Likewise, there is no particular limitation on the upper limit of the arithmetical mean roughness (Ra) of the surface of roughened stainless steel, but the upper limit is for example 1.0 μm or less, and may be 0.8 μm or less, or 0.7 μm or less.

There is no particular limitation on the size, thickness and shape of stainless steel to be subjected to the roughening treatment, and this treatment may be performed on stainless steel foils, by way of example.

The thickness of stainless steel to be subjected to the roughening treatment method of the present invention is not limited in any way, but it is for example 1 μm or more and 500 μm or less, and preferably 5 μm or more and 100 μm or less. The thickness of stainless steel is more preferably 15 μm or less.

In particular, the thickness of stainless steel to be subjected to the roughening treatment is generally uniform, but it is preferred that regions of stainless steel on which the roughening treatment is performed have at least sites whose thickness is 15 μm or less, or all the regions of stainless steel on which the roughening treatment is performed may have a thickness of 15 μm or less.

Thus, even when performed on stainless steel whose thickness is small, roughening treatment with an aqueous composition comprising the above components can result in roughened stainless steel whose portions having undergone the roughening treatment have a substantially uniform thickness (except for fine unevenness on the surface) and can prevent the occurrence of extremely thin regions or pinholes.

The thickness of stainless steel or stainless steel foils to be subjected to the roughening treatment may be, for example, 12 μm or less, and may be 10 μm or less, 8 μm or less, or 6 μm or less. However, stainless steel or stainless steel foils having a thickness of 20 μm or less, 30 μm or less, 50 μm or less, etc., may also be subjected to the roughening treatment.

In addition, the lower limit of the thickness of stainless steel or stainless steel foils is not limited in any way, but it is for example 1.0 μm. The thickness of stainless steel or stainless steel foils may be, for example, 1.5 μm or more, 2.0 μm or more, 3.0 or more, or 5.0 μm or more.

Moreover, regions of stainless steel or stainless steel foils on which the roughening treatment is performed preferably have at least sites whose thickness is within the above range. Alternatively, all the regions of stainless steel on which the roughening treatment is performed preferably have a thickness within the above range. Furthermore, all the regions of stainless steel are preferably within the above range, regardless of whether they undergo the roughening treatment.

[4. Method for Manufacturing Stainless Steel]

The method for manufacturing stainless steel of the present invention comprises at least the above roughening treatment step. According to the method for manufacturing stainless steel of the present invention, it is possible to manufacture stainless steel which has a rougher surface than before the roughening treatment, i.e., a more uneven surface than the untreated surface.

Stainless steel to be subjected to the method for manufacturing stainless steel of the present invention is as described in the above section [3. Stainless steel].

The maximum height (Rz) and arithmetical mean roughness (Ra) of the surface of roughened stainless steel obtained by the method for manufacturing stainless steel of the present invention are as described in the above section [3. Stainless steel].

Roughened stainless steel obtained by the method for manufacturing stainless steel of the present invention can be used, for example, in battery current collector foils for solid-state batteries or lithium-ion batteries, etc., solar battery substrates, flexible substrates for electronic devices, substrates for electric accumulator devices, carriers for exhaust gas purification catalysts, etc., electromagnetic wave shielding members, heat radiating members, and other applications. Roughened stainless steel foils obtained by the method for manufacturing stainless steel of the present invention are preferred for use as battery current collector foils, by way of example.

EXAMPLES

The present invention will be further described in more detail by way of the following examples, which are not intended to limit the scope of the invention.

<Measurement of Surface Roughness of Stainless Steel Foil>

The stainless steel foil used as a starting material, and the surface-treated foils obtained in the following examples and comparative example were measured for their maximum height (Rz) and arithmetical mean roughness (Ra) according to JIS B 0601-2001 with a laser microscope (manufactured by Keyence Corporation, Japan; product name: "VK-X250").

<Confirmation of the Presence or Absence of Pinholes>

The surface-treated foils obtained in the examples and comparative example were visually observed for their surface pattern. A foil showing no occurrence of pinholes (fine through holes) was evaluated as "good" while a foil showing the occurrence of pinholes was evaluated as "poor."

<Measurement of pH Value>

The pH values of the aqueous compositions in the examples and comparative example were measured at 25° C. with a pH meter (pH meter F-52, manufactured by Horiba, Ltd., Japan).

<Measurement of Etching Rate (E.R.)>

The value of E.R. (μm/min) was calculated as follows for the surface-treated foils obtained in the examples and comparative example: a mass difference (D) in each stainless steel foil before and after treatment with each aqueous composition was divided by the area S of the stainless steel foil used (i.e., the area treated with the aqueous composition), the density (ρ) of the stainless steel foil, and the treatment time (T).

Namely, the value of E.R. was calculated according to the following equation (1). It should be noted that the value of E.R. calculated directly from equation (1) has a unit of (cm/min), and data obtained in (cm/min) were converted into the unit of (μm/min) and shown in Table 1 and Table 2 below.

$$\frac{\text{Mass difference } D \text{ (g) in stainless steel foil before and after treatment}}{\text{Density } \rho \text{ (g/cm}^3\text{) of stainless steel foil} \times \text{Area } S \text{ (cm}^2\text{) of stainless steel foil} \times \text{Treatment time } T \text{ (min)}} \quad (1)$$

Example 1

A stainless steel (foil) was provided which had a thickness of 10 μm and a length and width of 30 mm×30 mm and whose material was SUS304. This stainless steel foil was found to have an Rz of 1.26 μm and an Ra of 0.08 μm, as measured in accordance with the above section <Measurement of surface roughness of stainless steel foil>. These values for the surface roughness of the untreated stainless steel foil are shown as the reference example in Table 1 below.

To 130 ml of ultrapure water, hydrogen peroxide in a final amount of 0.5% by mass (1.7 g of a 60 wt % aqueous hydrogen peroxide solution) and 34% by mass (68.6 g) of a 35 wt % aqueous hydrochloric acid solution were added to prepare an aqueous composition. The concentration of halide ions ($Cl^-$) derived from hydrochloric acid in this composition was 12% by mass based on the total amount of the aqueous composition.

The above stainless steel foil was soaked for 60 seconds in the above aqueous composition at a solution temperature of 35° C. Then, the soaked stainless steel foil was washed well with ultrapure water, and then dried well to obtain the surface-treated foil. The resulting surface-treated foil was found to have an Rz of 1.17 μm and an Ra of 0.12 μm, as measured in accordance with the above section <Measurement of surface roughness of stainless steel foil>. Moreover, the resulting surface-treated foil was visually observed for its surface pattern in accordance with the above section <Confirmation of the presence or absence of pinholes>, thus indicating that the surface-treated foil showed no occurrence of pinholes (fine through holes) and was evaluated as "good."

Example 2

The same roughening treatment as shown in Example 1 was performed on the stainless steel foil to obtain the surface-treated foil, except that 2.0 g of copper sulfate pentahydrate was further added to the aqueous solution in Example 1 to give the composition indicated in Table 1 below.

The concentration of copper ions (Cu 2±) derived from copper sulfate in this aqueous composition was 0.25% by mass based on the total amount of the aqueous composition.

The results including Rz and Ra values obtained for the resulting surface-treated foil are shown in Table 1 below.

Examples 3 to 6 and 12 to 15 and Comparative Example 1

The same roughening treatment as shown in Example 1 was performed on the stainless steel foil to obtain the surface-treated foils, except that at least any of the concentrations of hydrogen peroxide, chloride ions and copper ions ($Cu^{2+}$) in the aqueous composition is changed to give the compositions indicated in Table 1 below.

The results including Rz and Ra values obtained for the resulting surface-treated foils are shown in Table 1 below.

TABLE 1

| | Components of aqueous composition | | | | Pattern evaluation of stainless steel foil | | | |
|---|---|---|---|---|---|---|---|---|
| | | | | | SUS304 | | | |
| | Hydrogen peroxide/ wt % | Copper ion wt % | Chloride ion wt % | Solution pH | Ra/ μm | Rz/ μm | ER/ μm/min | Pinhole evaluation |
| Example 1 | 0.5 | 0 | 12 | 0.1 | 0.12 | 1.17 | 1.35 | Good |
| Example 2 | 0.5 | 0.25 | 12 | 0.1 | 0.19 | 1.64 | 1.53 | Good |
| Example 3 | 0.5 | 0.5 | 12 | 0.1 | 0.25 | 2.17 | 1.88 | Good |
| Example 4 | 0.3 | 1.5 | 12 | 0.1 | 0.27 | 2.47 | 1.94 | Good |
| Example 5 | 0.1 | 0 | 12 | 0.1 | 0.14 | 1.28 | 0.10 | Good |
| Example 6 | 1.0 | 0 | 12 | 0.1 | 0.13 | 1.19 | 1.65 | Good |
| Example 12 | 0.5 | 0.1 | 12 | 0.1 | 0.18 | 1.27 | 2.07 | Good |
| Example 13 | 1.0 | 0 | 20 | 0.01 | 0.14 | 1.23 | 2.76 | Good |
| Example 14 | 1.0 | 1.0 | 20 | 0.01 | 0.59 | 2.96 | 2.17 | Good |
| Example 15 | 0.5 | 1.5 | 12 | 0.1 | 0.38 | 2.34 | 3.65 | Good |
| Comparative Example 1 | 0.3 | 4.5 | 12 | 0.1> | 0.28 | 2.47 | 2.65 | Poor |
| Reference Example (untreated) | — | — | — | — | 0.08 | 1.26 | — | — |

Examples 7 to 11

Using a stainless steel (foil) whose material was SUS444 (Rz: 0.88 μm, Ra: 0.09 μm), the same roughening treatment as shown in Example 1 was performed on the stainless steel foil to obtain the surface-treated foils, except that the concentrations of hydrogen peroxide, copper ions ($Cu^{2+}$) and halide ions ($Cl^{-}$) in the aqueous composition were adjusted as indicated in Table 2 below.

The results including Rz and Ra values obtained for the resulting surface-treated foils are shown in Table 2 below.

TABLE 2

| | Components of aqueous composition | | | | Pattern evaluation of stainless steel foil | | | |
|---|---|---|---|---|---|---|---|---|
| | | | | | SUS444 | | | |
| | Hydrogen peroxide/ wt % | Copper ion wt % | Chloride ion wt % | Solution pH | Ra/ μm | Rz/ μm | ER/ μm/min | Pinhole evaluation |
| Example 7 | 0.5 | 0 | 12 | 0.1 | 0.38 | 2.46 | 0.53 | Good |
| Example 8 | 0.5 | 0.25 | 12 | 0.1 | 0.54 | 3.35 | 0.70 | Good |
| Example 9 | 0.5 | 0.5 | 12 | 0.1 | 0.63 | 3.82 | 0.92 | Good |
| Example 10 | 0.1 | 0 | 12 | 0.1 | 0.13 | 1.46 | 0.10 | Good |
| Example 11 | 1.0 | 0 | 12 | 0.1 | 0.33 | 3.01 | 1.12 | Good |
| Reference Example (untreated) | — | — | — | — | 0.09 | 0.88 | — | — |

INDUSTRIAL APPLICABILITY

According to the present invention, when using an aqueous composition of particular composition, the surface of stainless steel can be sufficiently roughened in an efficient manner with few steps and in a short time, and it is further possible to achieve stainless steel of good quality, particularly having a uniform thickness and no defects such as pinholes. Moreover, when stainless steel, particularly a stainless steel foil, whose surface has been thus roughened while maintaining a good appearance is used in battery current collector foils, automotive component housings, etc., dielectric substances or organic materials can be effectively adhered or held. Also in the case of members for heat radiation, stainless steel with a roughened surface may preferably be used.

Accordingly, the present invention has industrial applicability in the field of surface roughening treatment of stainless steel for use in material members, e.g., the above products.

The invention claimed is:

1. An aqueous composition for roughening the surface of stainless steel, which comprises:

0.3% to 10% by mass of hydrogen peroxide based on the total amount of the aqueous composition;

12% to 30% by mass of halide ions based on the total amount of the aqueous composition; and greater than 0% by mass to 3% by mass of copper ions based on the total amount of the aqueous composition, wherein said halide ions are chloride ions.

2. The aqueous composition according to claim 1, wherein a compound supplying the halide ions comprises one or more selected from the group consisting of hydrochloric acid, sodium chloride and copper chloride.

3. The aqueous composition according to claim 1, wherein the content of the copper ions is 1.5% by mass or less based on the total amount of the aqueous composition.

4. The aqueous composition according to claim 1, wherein the content of the hydrogen peroxide is 0.5% to 3% by mass based on the total amount of the aqueous composition.

5. The aqueous composition according to claim 1, wherein said composition comprises no halide ions other than chloride ions.

6. The aqueous composition according to claim 1, wherein said composition comprises no fluoride, bromide, or iodide ions.

7. The aqueous composition according to claim 1, wherein the content of the copper ions is 0.07% by mass to 2% by mass based on the total amount of the aqueous composition.

8. The aqueous composition according to claim 1, wherein the content of the copper ions is 0.07% by mass to 1.5% by mass based on the total amount of the aqueous composition.

9. The aqueous composition according to claim 1, wherein the content of the copper ions is 0.1% by mass to 1% by mass based on the total amount of the aqueous composition.

10. The aqueous composition according to claim 1, wherein the content of the copper ions is 0.1% by mass to 0.5% by mass based on the total amount of the aqueous composition.

* * * * *